US005245756A

United States Patent [19]

Howell et al.

[11] Patent Number: 5,245,756

[45] Date of Patent: Sep. 21, 1993

[54] LOCKABLE KNIFE BLOCK

[76] Inventors: Howell, 1003 Pearson Dr., Ovideo, Fla. 32765; Robin S. Howell, 5227 High St., Lincoln, Nebr. 68506

[21] Appl. No.: 952,251

[22] Filed: Sep. 28, 1992

[51] Int. Cl.[5] ..... B26B 27/00; B26B 3/06; B24D 15/00

[52] U.S. Cl. ..... 30/298.4; 30/151; 51/214

[58] Field of Search ..... 30/138, 151, 162, 296, 30/298.4, 299; 5/214, 204, 205; 224/232

[56] References Cited

U.S. PATENT DOCUMENTS

| | | | |
|---|---|---|---|
| 2,783,536 | 3/1957 | McQueary | 30/151 |
| 3,524,570 | 8/1970 | Seguine | 224/2 |
| 3,774,350 | 11/1973 | Bayly | 51/214 |
| 4,604,836 | 5/1986 | Huang | 51/214 |
| 4,718,200 | 1/1988 | Miqublot | 51/214 |
| 4,866,845 | 9/1989 | McEvily | 30/138 |
| 4,869,027 | 9/1989 | McEvily | 51/204 |
| 4,964,554 | 10/1990 | Collins | 50/151 |
| 5,009,040 | 4/1991 | Petroff | 51/214 |
| 5,067,239 | 11/1991 | Collins | 30/151 |
| 5,123,167 | 6/1992 | Kelley | 30/151 |

*Primary Examiner*—Frank T. Yost
*Assistant Examiner*—Paul M. Heyrana
*Attorney, Agent, or Firm*—Michael K. Gray

[57] ABSTRACT

A lockable knife and block assembly having a knife block having a plurality of slots for housing a plurality of knife blades. Each knife blade is provided with a notch for engaging a spring-loaded locking and latching means located at the top and front of each slot. A spring-loaded biasing means is positioned at the bottom and front of each slot to bias a blade entering a respective slot toward the spring loaded latching means. A push button release mechanism is attached to each locking and latching means for disengaging a knife blade latched thereto.

14 Claims, 3 Drawing Sheets

LOCKABLE KNIFE BLOCK

BACKGROUND OF THE INVENTION

1. Field of the Invention

The present invention pertains to knife blocks and cases for storing knives. More particularly, the present invention pertains to a knife block and knife assembly in which a plurality of knives are housed in a knife block. The knife block and knife assembly of the present invention has a plurality of slots with each slot being provided with a locking means which engages a knife blade after the knife blade is fully inserted into the slot locking the knife therein. The locking means of each slot is provided with a releasing means which can be activated to remove a knife when desired. Each slot of the plurality of slots of the knife block and knife assembly of the present invention is further provided with means for sharpening a knife each time the knife is inserted into and removed from the slot.

2. Discussion of the Background

In virtually any modern kitchen setting, knives of various varieties and sorts can be found. Most often large knives, such as carving knives, are stored in cases or knife blocks located on kitchen counters or tables. In that such cases and knife blocks are often accessible to young children who are not old enough to appreciate the inherent danger and proper use of a knife, it is desirable that knife blocks be provided with means for preventing a young child from disengaging a knife from a knife block.

SUMMARY OF THE INVENTION

Accordingly, one object of the present invention is to provide an economical knife block and knife assembly which is provided with means for locking a knife blade inside of a knife block so as to prevent the knife from being extracted by a small child.

Still another object of the present invention is to provide a knife block and knife assembly which is simple in construction, with the aforementioned locking means being provided with a release means which allows a mature individual to easily remove a knife from the knife block.

Yet another object of the present invention is to provide a knife block which is further provided with a sharpening means.

These and other valuable objects and advantages of the present invention are provided by a lockable knife block and knife assembly. The knife block is provided with a plurality of slots for accommodating the blades of a plurality of knives. Each slot of the plurality of slots is provided with locking means for locking a knife blade of a knife therein. The locking means is connected to the interior of the knife block. Each knife blade has a corresponding slot which is sized to accommodate a given blade. Each given blade is provided with an engaging means which engages the locking means once the given blade has been fully inserted into its corresponding slot. A sharpening means is provided with each slot which sharpens a given knife blade each time the knife blade is inserted into and removed from its corresponding slot. The sharpening means is connected to the interior of the knife block and is positioned to engage the cutting edge of a given knife. The sharpening means is further provided with a biasing means which biases a given knife blade toward the locking means located in a corresponding slot.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

When referring to the drawings, it should be understood that like reference numerals designate identical or corresponding parts throughout the respective references.

DETAILED DESCRIPTION OF THE INVENTION

Figure 1:
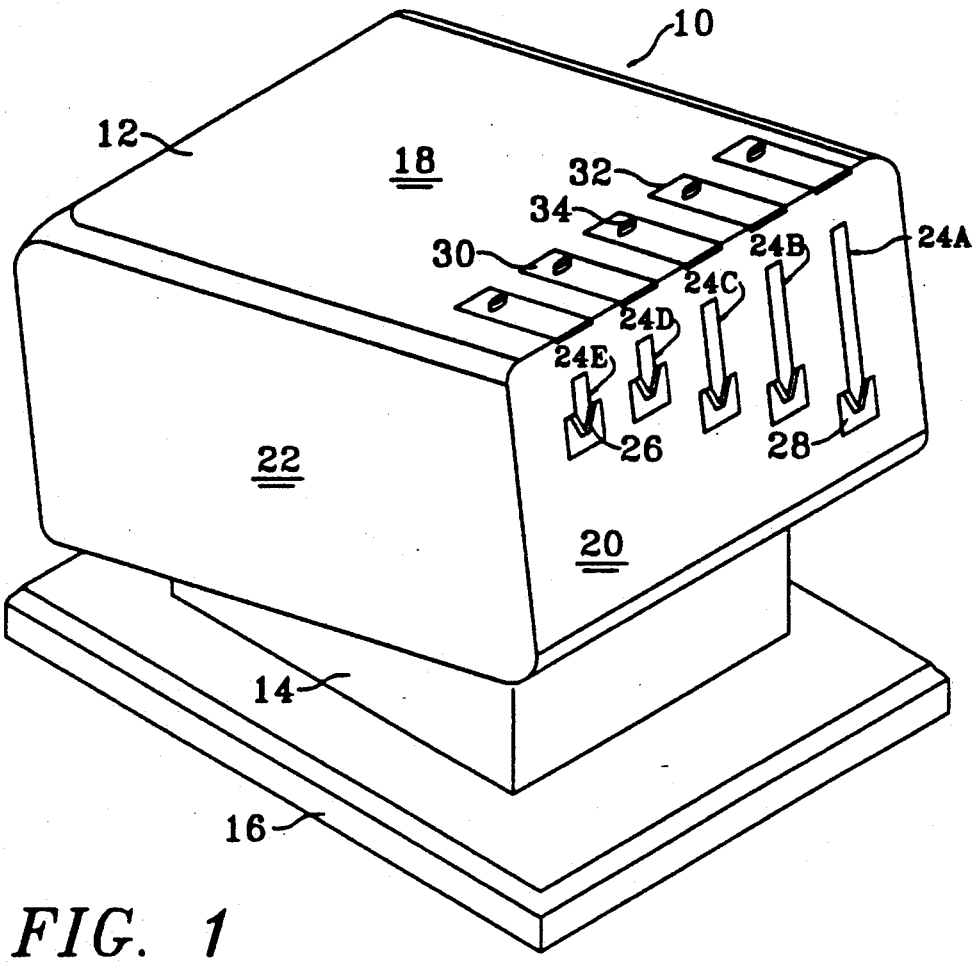
FIG. 1 is a perspective illustration of the knife block of the present invention.

With reference to FIG. 1, a knife block 10 according to the present invention is comprised of knife housing 12, support member 14, and base 16. The support member 14 is sloped such that knife blades when inserted into the knife housing 12 follow a downwardly-sloped path. The knife housing 12 includes a top 18, a front side 20 and lateral side 22. On the front side 22 a plurality of slots 24A, 24B, 24C, 24D, 24E are positioned. Slots 24A, 24B, 24C, 24D, 24E are of various sizes and extend into the knife housing 12 so as to be able to accommodate a plurality of correspondingly-shaped knife blades.

Figure 2:
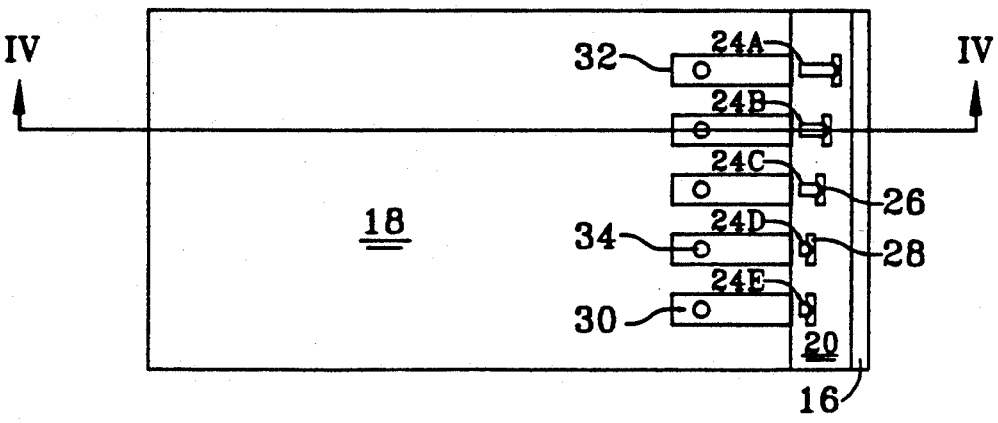
FIG. 2 is a top-view illustration of the knife block depicted in FIG. 1.

At the bottom and entrance of each slot 24 is a sharpener 26 which forms a V-shape and contacts a face plate 28 which is substantially parallel to the surface of front side 20 of knife housing 12. Associated with each slot 24 and positioned at the top 18 of knife housing 12 proximate to the front side 20 is knife locking and releasing means 30. The top surface 32 of knife lock and releasing means 30 includes a push button 34. Top surface 32 of locking and releasing means 30 is substantially parallel to the surface of top 18 of knife housing 12. FIG. 2, further demonstrates how the plurality of knife lock and releasing means 30 are positioned upon the top 18 of knife housing 12. In effect, the knife lock and releasing means 30 is comprised of a locking means, e.g, top region 32, locking latch 54 and angle spring 60, and a push-button disengaging means, e.g, the push-button 34 (see FIG. 4 discussed subsequently).

Figure 3:
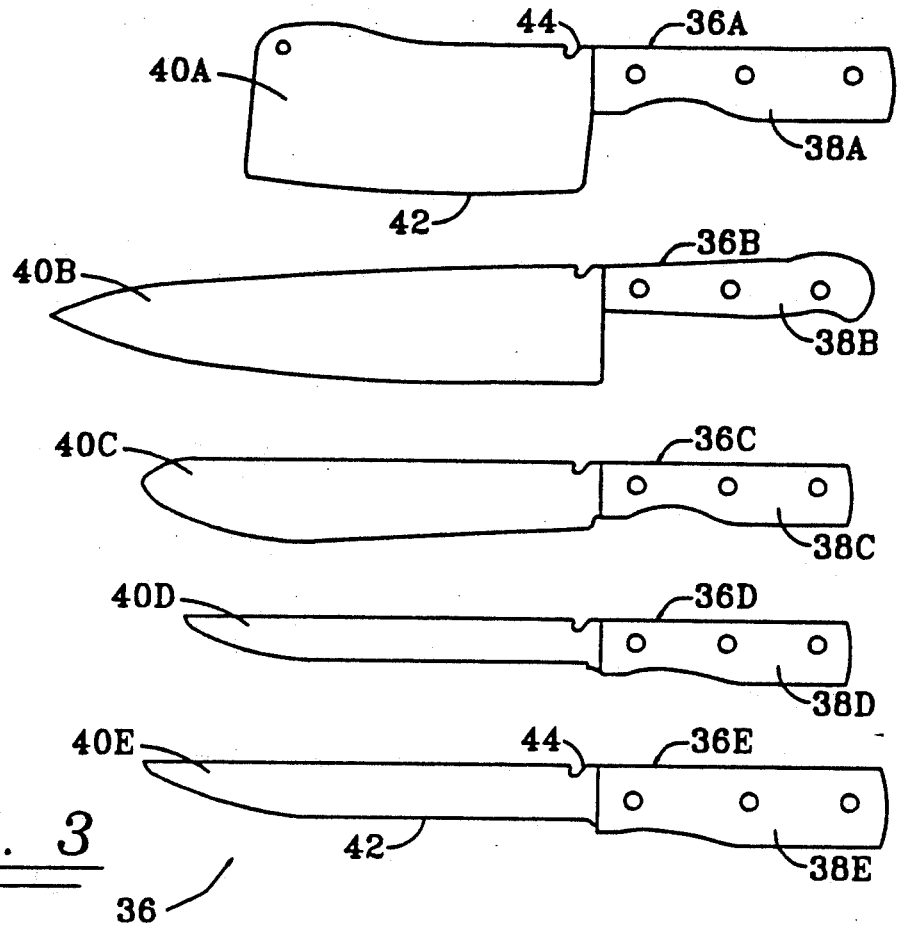
FIG. 3 is a side-view illustration of the plurality of knives of the knife block and knife assembly of the present invention.

FIG. 3 demonstrates a plurality of knives 36 according to the present invention. Knife 36A corresponds to and is for insertion into slot 24A of FIG. 1. Knife 36A is depicted as a meat cleaver and has a handle 38A, a blade 40A, a cutting edge 42A, and a notch 44 located at the side of the blade 40A which is opposite to the cutting edge 42A. Notch 44 is proximate to the location where the blade 40A interfaces with handle 38A. Knife 36B is depicted as a butcher knife and is for insertion into slot 24B of FIG. 1. Knife 36B has a handle 38B and a blade 40B and is equipped with the same parts as knife 36A, only in a different shape and size. Likewise knives 36C, 36D and 36E are provided with handles, and blades of various sizes with all of the knives being provided with a notch 44 which is the same size in all of the knives. Knife 36C is for insertion into slot 24C (of FIG. 1), Knife 36D is for insertion into slot 24D, and knife 36E is for insertion into slot 24E.

Figure 4:
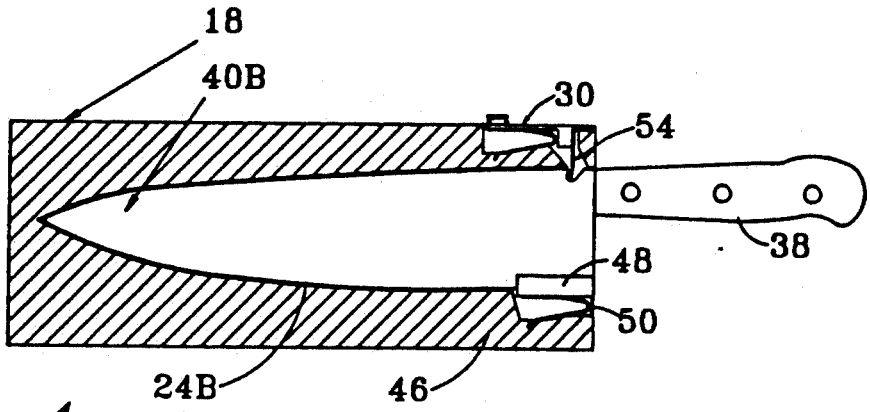
FIG. 4 is a side-view, cross-sectional illustration taken along line IV—IV of FIG. 2 which depicts a knife in a corresponding slot according to the present invention.

FIG. 4 is a side-view cross-sectional illustration taken along line IV—IV of FIG. 2 and depicts the interior of slot 24B with blade 40B inserted therein. The solid interior 46 of the knife housing 12 surrounds the respective slots 24 as is depicted by slot 24B of FIG. 2. The knife housing block 12 can be solid wood, or the slots 24 can be formed of a tough and durable molded plastic or other suitable material, if so desired.

FIG. 4 further demonstrates that the knife lock and releasing means 30 extends into a cavity in the interior of the knife housing block 12 and is secured to the solid interior 46 of the knife housing 12. The cavity should be shaped such that when a knife is inserted into its respective slot, very little vertical movement will be allowed. Such limited vertical movement will prevent small children from pulling down on a knife handle 38 so as to compress angle spring 50 and disenage locking latch 54 from notch 44 of the knife. The cavity in which the knife lock and releasing means is situated extends into slot 24B (FIG. 4) so as to allow the locking latch 54 to descend from the underside of the top 32 of knife lock and releasing means 30. The locking latch 54 extends just far enough into slot 24B so as to allow the locking latch to engage the notch 44 of blade 40B. Blade 40B (as demonstrated in FIG. 4) is in a locked-fully-inserted position inside of slot 24B.

Still with reference to FIG. 4, the cutting-edge side 42 of knife blade 40B engages a biasing means 52 which is comprised of angle spring 50, sharpener housing 48, sharpener 26 (see FIG. 1), and face plate 28 (see FIG. 1). Biasing means 52 will be more fully explained in the subsequent commentary regarding FIGS. 6A and 6B.

Figure 5A:
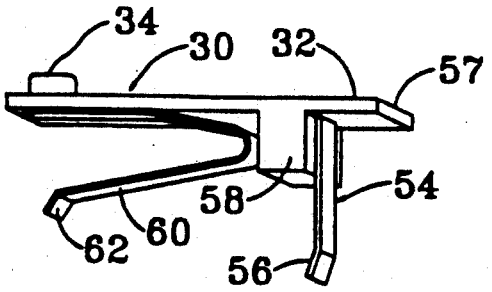
FIG. 5A is a perspective illustration of the knife lock and releasing means of the present invention.
Figure 5B:
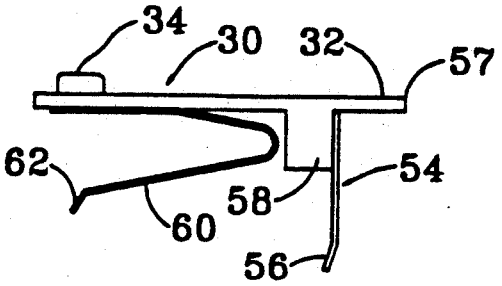
FIG. 5B is a side-view illustration of the knife lock and releasing means of the present invention.
Figure 5C:
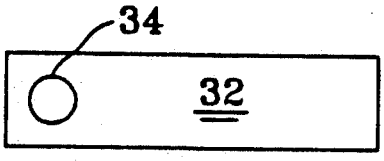
FIG. 5C is a top-view illustration of the knife lock and releasing means of the present invention.

FIG. 5A provides a detailed illustration of the knife lock and releasing means 30 of the present invention. Knife lock and releasing means 30 is comprised of top 32 from which descends flange 58. Locking latch 54 is connected to the underside of top 32 and to the flange 58. Locking latch 54 has a slanted end portion 56 for purposes of engaging a notch 44 of a knife (see FIGS. 3 and 4). The locking latch 54 and particularly the slanted end portion 56 of the locking latch 54 should be made of a durable metal or metal alloy or other suitable material so that repeated contact with a knife blade will not affect the performance of the locking latch 54. Knife lock and releasing means 30 is further comprised of push button 34 which is attached to exterior side of top 32. Connected to the underside of top 32 is angle spring 60 which has a C-shape. A distal end portion of angle spring 60 has a securing extension 62 which is bent and angled downward for purposes of embedding into the solid interior 46 of knife housing 12 (see FIG. 4). The side-view illustration of FIG. 5B gives a further understanding of the components of the knife lock and releasing means 30 which have been described in relation to the commentary concerning FIG. 5A.

By pushing down upon push button 34, front end 57 of knife lock and releasing means 30 is pulled upward so as to raise the locking latch 54. As end 57 is raised in an upward fashion, the locking latch 54 is disengaged from a notch 44 of a knife blade to allow easy removal of the knife from the knife housing 12. The angle spring 60 should be made of a flexible metal or metal alloy or an appropriate substitute material to allow for the desired flexibility and elasticity.

Figure 6A:
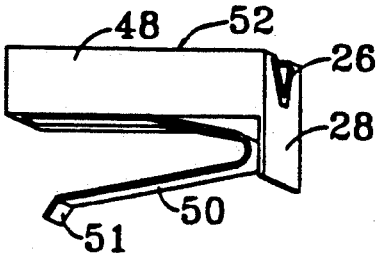
FIG. 6A is a perspective illustration of the sharpener and biasing means of the present invention.
Figure 6B:
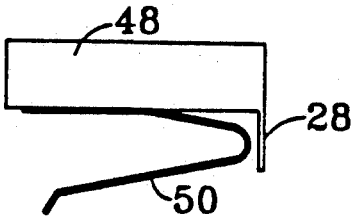
FIG. 6B is a side-view illustration of the biasing means of the present invention.

With reference to FIG. 6A, biasing means 52 is comprised of sharpener housing 48 which includes face plate 28. Sharpener housing 48 has a grooved interior which extends the length of sharpener housing 48 to accommodate the sharpener 26 which is securely attached thereto. The sharpener can be made of flint or an appropriate metal or metal alloy known in the art to provide superior blade-sharpening results. The sharpener housing should be made of a strong, lightweight, flexible metal, metal alloy or other appropriate material. The angle spring 50 is connected to the underside of sharpener housing 48. The distal end portion of angle spring 50 has a securing extension 51 which is bent downward for installation and anchoring of the angle spring and biasing means 52 into the solid interior 46 of the knife housing 12 (see FIG. 4). When a knife blade is inserted into a slot 24 the knife blade is sharpened by sharpener 26 and the knife blade is biased in such a manner, due to angle spring 50, that the notch of the knife blade is urged to engage the latch 54 (see FIG. 4).

Thus, in using the present invention, knife blade 40 is fully-inserted into an appropriate slot. The notch 44 provided on the knife blade 40 will engage the locking latch 54 and render the knife blade 44 in a locked position. To disengage the knife blade, one needs to simply push down upon the push button 34 whereupon the knife blade will be released for easy removal from the knife housing 12.

The present invention will provide an added measure of safety to the kitchen environment, particularly in its preventing small children from coming into possession with a dangerous knife. However, even mature adults will benefit from the present invention in that each time an adult presses a bush button 34 to disengage a knife, he or she will be reminded of the inherent dangers of knives.

The foregoing detailed description of the present invention is intended to be illustrative and non-limiting. Many changes and modifications are possible in light of the above teachings. Thus, it is understood that the invention may be practiced otherwise than is specifically described herein and still be within the scope of the appended claims.

What is claimed is:

1. A lockable knife block and knife assembly comprising:

at least one knife having a knife blade of a predetermined size;

a knife housing block having at least one slot for accommodating said knife blade of a predetermined size;

locking means connected to said knife housing block for locking said knife blade of a predetermined size in a locked-fully inserted position in the at least one slot, said locking means having push-button release means for disengaging said knife blade of a predetermined size from the locked-fully-inserted position, said locking means comprises a top region, a locking latch, and an angle spring which are connected together; and wherein said top region is substantially parallel to a top surface of said knife housing block.

2. A lockable knife block and knife assembly, according to claim 1, further comprising:

biasing means connected to said knife housing block for biasing said knife blade of a predetermined size toward said locking means.

3. A lockable knife block and knife assembly according to claim 2, wherein said biasing means is further comprises of blade sharping means for sharpening a cutting edge of said knife blade of a predetermined size.

4. A lockable knife block and knife assembly according to claim 3, wherein:

a push button connected to said top region of said locking means comprises said push-button release means.

5. A lockable knife block and knife assembly according to claim 4, wherein:

said biasing means comprises an angle spring and a sharpener housing, said angle spring connecting to said knife house block and to said sharpener housing.

6. A lockable knife block and knife assembly according to claim 5, further comprising:

a blade sharpener connected to said sharpener housing and extending the length of said sharpener housing.

7. A lockable knife block and knife assembly according to claim 6, wherein:

said knife blade of said at least one knife is provided with a notch located on a side of said knife blade opposite the cutting edge of said knife blade, said notch being located proximate to a handle of said at least one knife, said notch being for the purpose of engaging said locking latch of said locking means.

8. A lockable knife block and knife assembly according to claim 6 wherein said push button is located at an end of said top region of said locking means opposite to a front end of said top region such that when said push button is pressed down upon, said front end of said top region and said locking latch are raised in an upward direction.

9. A lockable knife block and knife assembly according to claim 8, wherein:

said locking latch is substantially perpendicular to said top region of said locking means, said locking latch being positioned in a cavity inside of said knife housing block which is spatially connected to said at least one slot of said knife housing block.

10. A lockable knife block and knife assembly, comprising:

at least one knife having a knife blade of a predetermined size, the knife blade of a predetermined size having a cutting edge;

a knife housing block having at least one slot for accommodating said knife blade of a predetermined size;

knife locking and releasing means, connected to the interior of said knife housing block, for locking and releasing said at least one knife from said at least one slot;

biasing means, connected to the interior of said knife housing block, for biasing said knife blade toward said knife locking and releasing means; and wherein, when said at least one knife is inserted into said at least one slot, the knife blade is located between said knife locking and releasing means and said biasing means, said biasing means contacting the cutting edge of said at least one knife.

11. A lockable knife block and knife assembly, according to claim 10, wherein said knife lock and releasing means comprises:

a top, an angle spring and a locking latch, said top, said angle spring and said locking latch being connected.

12. A lockable knife block and knife assembly according to claim 11, wherein said biasing means comprises:

a sharpener housing and a biasing angle spring, said sharpener housing and said biasing angle spring being connected together.

13. A lockable knife block and knife assembly according to claim 12, wherein:

the knife blade of a predetermined size is provided with a notch for engaging said locking latch of said knife locking and releasing means.

14. A lockable knife block and knife assembly according to claim 13, further comprising:

a push button connected to the top surface of said knife lock and releasing means.

* * * * *